United States Patent [19]

Hoffmann et al.

[11] Patent Number: 4,735,668

[45] Date of Patent: Apr. 5, 1988

[54] METHOD OF ADHERING LABELS TO CONTAINERS

[75] Inventors: Wolfgang W. Hoffmann, Modesto; Svatoboj Otruba, Ceres, both of Calif.

[73] Assignee: Shibuya America Corporation, Modesto, Calif.

[21] Appl. No.: 910,023

[22] Filed: Sep. 22, 1986

Related U.S. Application Data

[63] Continuation-in-part of Ser. No. 785,074, Oct. 7, 1985, Pat. No. 4,632,721.

[51] Int. Cl.[4] ..... B65C 9/20; B65C 9/22

[52] U.S. Cl. ..... 156/215; 156/264; 156/308.6; 156/314; 156/521; 156/568; 156/578; 156/DIG. 34; 156/DIG. 35

[58] Field of Search ..... 156/215, 578, DIG. 32, 156/568, 446, 449, 450, 521, 187, 264, 308.6, 314

[56] References Cited

U.S. PATENT DOCUMENTS

| | | | |
|---|---|---|---|
| 3,834,963 | 9/1974 | Hoffman | 156/215 |
| 4,416,714 | 11/1983 | Hoffmann | 156/215 |
| 4,443,285 | 4/1984 | Roth et al. | 156/215 |
| 4,574,020 | 3/1986 | Fosnaught | 156/215 |
| 4,592,796 | 6/1986 | Schlacht | 156/458 |

*Primary Examiner*—Michael Wityshyn

*Attorney, Agent, or Firm*—Melvin R. Stidham

[57] ABSTRACT

We have disclosed a method of applying a plastic label to a container wherein a label is severed from the strip of polymer label material. A hot melt adhesive is applied to an area along the leading edge of the label and a solvent of the polymer is applied to an area along the trailing edge of said material to form a tacky solution. The label is then applied to a container so that when heat shrunk, the tacky solution solidifies and the hot melt adhesive crystalizes to release its grip on the container.

7 Claims, 6 Drawing Sheets

METHOD OF ADHERING LABELS TO CONTAINERS

RELATED APPLICATION

This application is a continuation-in-part of our copending U.S. Application Ser. No. 06/785,074 filed Oct. 7, 1985 for "Apparatus for Applying Labels to Containers, now U.S. Pat. No. 4,632,721, granted Dec. 30, 1986."

BACKGROUND OF THE INVENTION

In conventional labeling machines, a continuous strip of label material is gripped and pulled at its leading edge by a rotating label transport drum, and an individual label is severed therefrom by cutting means located ahead of the drum. Transverse ridges or projections on the label transport drum press the label against a glue applicator and then press the leading edge of the label against a container. The label is then released and wrapped around the container.

In many labeling operations, the label is wrapped completely around the container so that the trailing edge overlaps the leading edge. Often in such cases, it is desirable to use one type of adhesive at the leading edge to adhere the label to the material of the container and another type of adhesive at the trailing edge that would be better adapted to adhere the two overlapping portions of the label together. For example, where certain plastic labels are applied to containers it has been found advantageous to seal the overlapped edges by applying a solvent to finite areas of the trailing edge to form a tacking solution. As described in Fumel U.S. Pat. No. 4,567,681, this bond becomes stronger as the solution solidifies and facilitates subsequent heat shrinking of the label. The Fumel patent also discusses the advantages of just a temporary bond between the leading edge of the label and the container itself so that the label can be easily removed for recycling the container, and it teaches the use of the same solvent for the leading edge as well.

However, since a hot melt glue will stick the leading edge of the label to the container instantly while such solvent takes time to set, there are distinct advantages in using separate sealing media for high speed production. With present vacuum drums, wherein the radial projections are fixed, only one glue wheel can be used.

OBJECTS OF THE INVENTION

It is an object of this invention to provide a labeling apparatus wherein a single transport drum can grip a strip of labeling material; sever a label from the strip; apply glue to its edges; and press the gummed leading edge against a container.

It is a further object of this invention to provide a labeling apparatus wherein the label transport drum may be conditioned to press the leading and trailing edges of a label against different bonding media applicators.

It is a further object of this invention to provide a plastic label for a container wherein a hot melt adhesive is applied to the leading edge for an instant bond with the container and a solvent is applied to the trailing edge to form a tacky solution that solidifies when the label is heat shrunk.

It is a further object of this invention to provide a container labeling apparatus wherein relatively small components of the label transport drum may be replaced when worn, to avoid replacement of the entire transport drum.

Further objects and advantages of this invention will become apparent from the description to follow, particularly when read in conjunction with the accompanying drawings.

SUMMARY OF THE INVENTION

In carrying out this invention, we provide means for feeding a continuous strip or web of container labeling material, means for delivering a supply of containers to a label applying station and a label transport drum for severing labels from the strip, applying different bonding materials to their leading and trailing edges and pressing the leading edge against the side of a container. The knife for severing the labels into lengths is carried directly on the label transport drum and the leading and trailing edges of the label are griped by vacuum pads which are movable radially on the drum. In operation, the leading edge of the strip is gripped by one vacuum pad and then, a trailing portion is gripped by a second vacuum pad. When the knife, which is immediately behind the second vacuum pad, passes a complementary stationary blade, the blades sever the label, both vacuum pads being retracted as they pass the stationary blade. As each pad approaches a glue roller, it may be extended to press the label against the roller and apply a strip of glue or other bonding medium. Where two different adhesives are to be applied to the leading and trailing edges, each pad is extended to press against one roller and retracted as it passes the other. In the case of plastic labels one roller may apply a strip or patch of a solvent that produces a tacky solution with the plastic material of the label. In either event, after the bonding materials are applied, the first pad is held extended to transfer the leading edge of the label to a container, either directly or through a label transferring mechanism. At about the same time, the vacuum is cut off and air pressure may be applied to release the label from the pad. Then both pads are retracted as they again approach the stationary blade.

DESCRIPTION OF A PREFERRED EMBODIMENT

Figure 1:
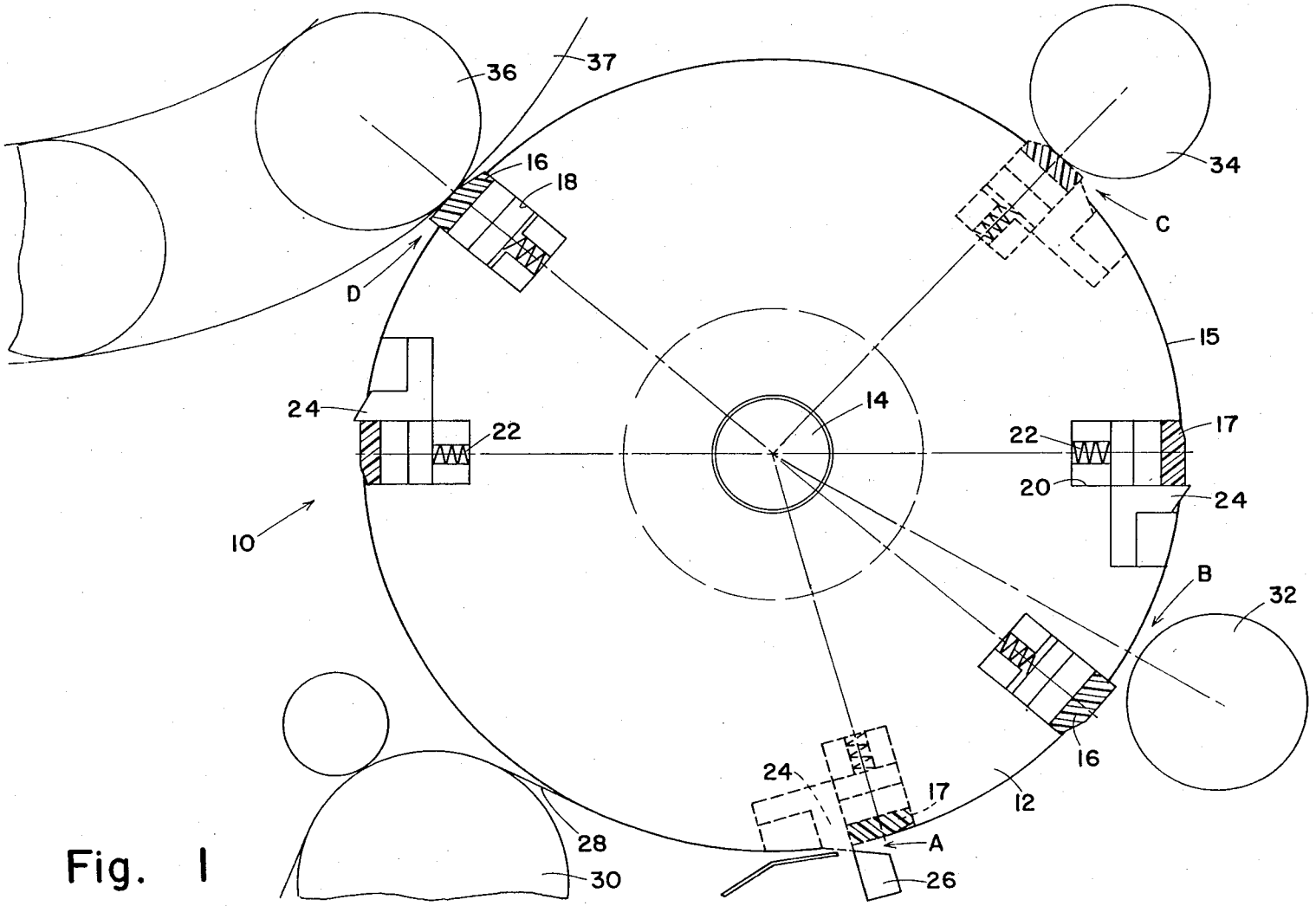
FIG. 1 is a schematic illustration of the apparatus of this invention showing the various stages of operation.

Referring now to FIG. 1 with greater particularity, the label applying apparatus 10 of this invention includes as its principal component a label transport drum 12, which is carried on a rotatable, driven shaft 14 and has a cylindrical label-supporting surface 15. Exposed on the cylindrical surface 15 are one or more leading edge gripping pads 16, each followed by a complementary trailing edge gripping pad 17. The gripping pads are slidably carried on the label transport drum 12 for reciprocal movement in a generally radial direction to extend them and retract them in radial slots 18 and 20.

The gripping pads 16 and 17 are biased outward by springs 22 and, as will be described hereinafter, are retracted by cam means.

Mounted on the label transport drum 12 closely adjacent each of the trailing edge gripping pads 17 is a cutting knife 24 that severs a label from a continuous web as it is moved by a stationary blade component 26 at station A. As used in this application, the term "stationary", as applied to the shear blade 26, means simply that it is in fixed position at the time of severing a label. However, it may actually be moved to pivot away from the label transport drum 12 by any suitable means, such as a hydraulic cylinder, to prevent engagement of the rotating blade 24 and the stationary shear blade 26 when no label material web is being fed to the label transport drum 12.

As the web or strip 28 of labeling material is fed by a feed roller 30 from a source of supply (not shown) onto the label transport drum 12, its leading edge is gripped by a leading edge gripping pad 16, which at the time, is retracted to avoid interference with the stationary blade 26. By reason of the fact that the rotational surface speed of the drum 12 is slightly greater than that of the feed roller 30, the label material web 28 is placed under slight tension. Then, as the drum 12 carries the cutting blade 24 past the stationary cutter 26 at station A, the associated trailing edge gripping pad 17 is also in retracted position, as shown in phantom. Hence, the blade 24 is exposed and the pad 17 will not interface with the cutting action of the blade.

After the leading edge of the label has moved past the first glue applying roller 32 at station B and approaches the glue roller 34 at station C, the leading edge gripping pad 16 is extended to press the label against the glue roller 34, applying a strip of glue at the leading edge of the label. If the same type glue is to be applied to the trailing edge, the trailing edge gripping pad 17 is likewise extended as it approaches the glue roller 34 to apply a strip of glue to the trailing edge. However, there may be instances wherein a different glue is to be applied to the trailing edge. This could occur, for example, if the leading edge is to adhered directly to a can or bottle and the trailing edge is to be adhered to the label itself, as by overlapping the leading edge. In such instance, the leading edge gripping pad 16 is extended as it approaches the second glue roller 34 at station C, and the trailing edge gripping pad 17, is extended to press the trailing edge of the label against the first glue roller 32, thereby applying glue to the trailing edge of the label. It is thereafter retracted to pass the second glue roller 34.

After glue has been applied to both the trailing and leading edges of the label, the label transport drum 12 rotates further to carry the label to some device for transferring the label to a container. For purposes of illustration, the leading edge pad 16 is shown pressing the label directly against a container 36, which is carried past the drum on a suitable conveyor, such as a turret 37. In this position at station D, the leading edge gripping pad 16 is extended to press the leading edge against the container and then it releases the label to allow the label to be wrapped about the container 36.

Figure 2:
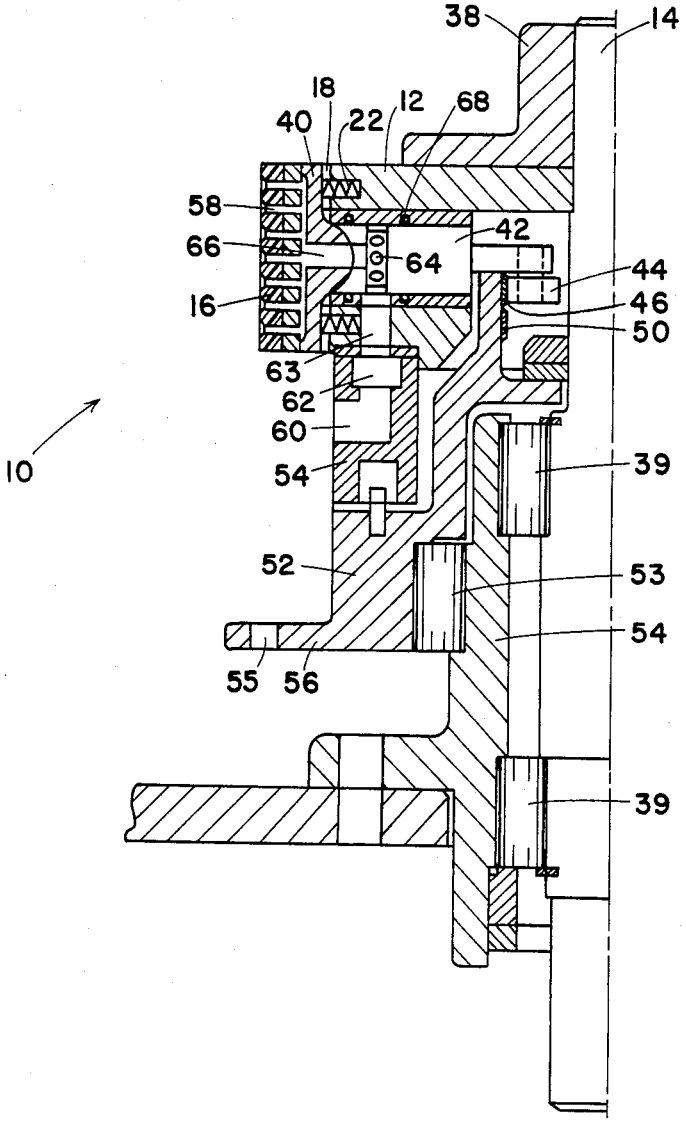
FIG. 2 is a partial section view of the tape transport drum of this invention.
Figure 3:
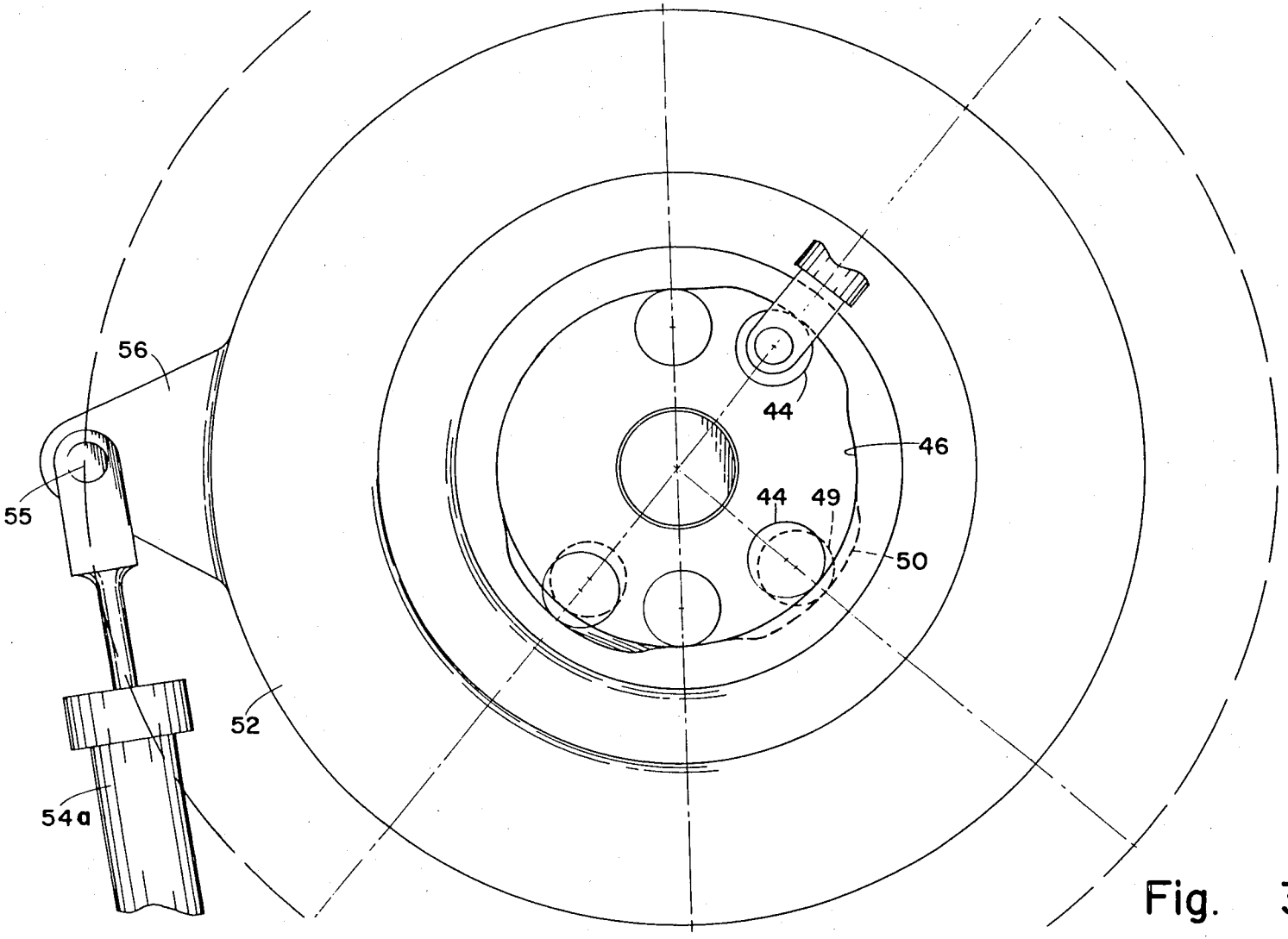
FIG. 3 is a plan view of the cam control mechanism.

Referring now to FIG. 2, the label transport drum 12 is shown mounted on the driven shaft 14 and secured by a mounting flange 38, the driven shaft 14 being rotatably mounted on bearings 39. The gripping or vacuum pad 16 is carried on a rectangular guide 40 received in the rectangular recess 18 on the drum. The guide 40 in turn is carried on a guide shaft 42 on the end of which is a cam follower roller 44. The cam follower 44 rolls around a cam track 46 to retract the guide shaft 42 against the action of the springs 22 when it is desired to retract the vacuum pad 16. A second cam follower 49 (FIG. 3) rolls around another cam track 50 to direct reciprocal action of the trailing edge gripping pad 17. By having the cam retract the vacuum pads 16 and 17 and the springs 22 extend them, the pads will yield somewhat as they press the labels against the glue rollers and the containers. On the other hand, cam-retraction of the pads is positive, so that failure of a spring will not result in interference with the stationary blade 26.

The cam tracks 46 and 50 are carried on a cam housing 52, which is mounted on bearings 53 for limited rotary movement on the machine frame 54. Hence, in the event of the absence of a label, as detected by suitable means, such as a conventional photosensing device, provision may be made for avoiding contact of the vacuum pads 16 and 17 with the glue applying rollers 32 and 34. In such event, the cam housing 52 is rotated through a small arc to delay operation of the cam followers 44 and 49 until the vacuum pads 16 and 17 have moved past the glue rollers 32 and 34. The partial rotation of the cam housing 52 may be accomplished by means of a pneumatic or hydraulic cylinder **54*a* (FIG. 3) pivotally connected at 55 to a radial arm 56 carried on the cam housing 52**.

Referring again to FIG. 2 the label gripping pads 16 (and 17 as well) may be made of an elastomeric material applied to the rectangular guide 40 to grip the label material by means of a vacuum drawing through a plurality of perforations 58 therethrough. A suitable fitting 60 on the frame 54 is connected to a source of vacuum (not shown) and opens into an arcuate slot 62 so that on rotation of the turret through the length of the slot, in conventional manner, the vacuum will be exposed through duct 63 and radial openings 64 in the guide shaft and an axial passageway 66 opening to the pad perforations 58, the guide rod 42 being sealed by suitable O-rings 68 as the guide shaft reciprocates through its short stroke. When the end of the slot 62 is reached, the duct 63 is shut off to the vacuum, and may even be exposed to an air hole (not shown) to cause the vacuum pad 16 to release the label.

Where plastic labels are employed, one of the glue rollers, say roller 32, may apply a solvent to the trailing edge of the label to form a strip or patch of a liquid tacky solution, as shown in the aforesaid U.S. Pat. No. 4,567,681, where methylene chloride is suggested as a solvent for use with a polystyrene label. After the label is wrapped around the container, the solution solidifies to form a solid bond. The other glue roller 34 preferably applies a hot melt adhesive that provides a quick bond with the container for attaching the leading edge of the label. If desired, the hot melt adhesive may be conditioned to crystalize under heat so that, as the label is heat shrunk, its bond to the container is weakened. However, with the overlapped edges firmly bonded, the label, when heat shrunk, grips around the container under tension.

Figure 4:
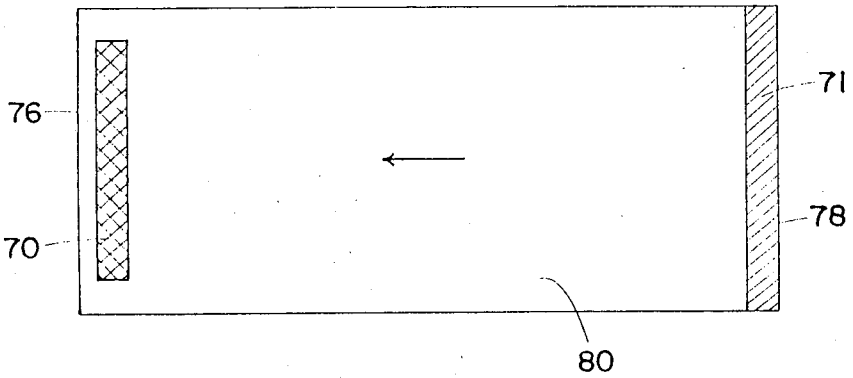
FIGS. 4 and 5 are plan views of plastic label embodiments.

As shown in FIG. 4, a strip 70 of hot melt adhesive is applied to the leading edge 76 of the label 80, and a second strip 71 of solvent is applied to the trailing edge 78 to form the tacky solution.

In order to achieve this bonding pattern, the leading edge gripping pad 16 remains retracted as it moves past the solvent applicator roller 32 and then it is extended as it moves past the glue roller 34. Following this, the trailing edge gripping pad 17 is extended as it passes the solvent applicator roller 32 to apply the strip of solvent and then is retracted as it passes the glue roller 34.

Figure 6:
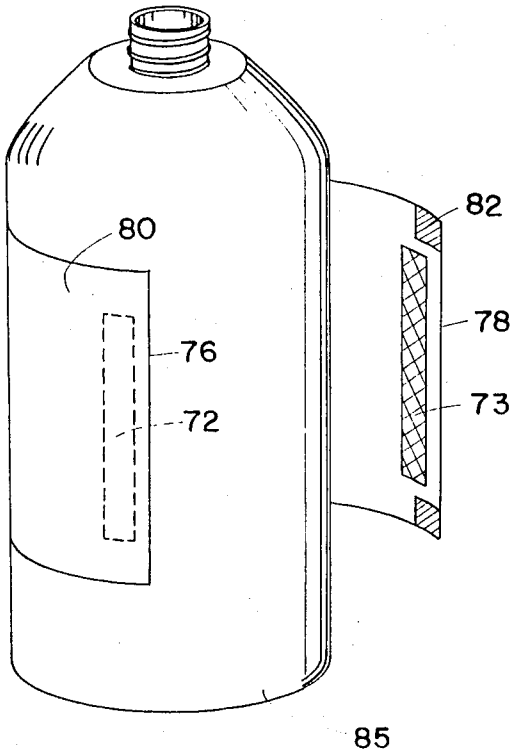
FIG. 6 is a view in perspective of a container with the label of FIG. 5 partially wrapped around it.
Figure 5:
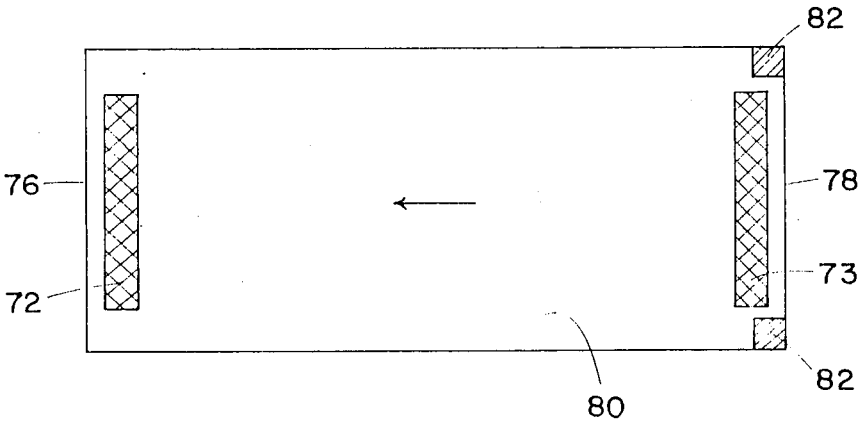

In some cases, it is preferred to reduce the amount of solvent used to a minimum and to apply it just as necessary to bond the label edges together during heat shrinking. Hence, as shown in FIG. 5, strips 72 and 73 of hot melt adhesive are applied to the leading and trailing edges 76 and 78 of the label 80, where they are not required to withstand the heat needed to shrink the label. Then at the top and bottom corners of the trailing edge 78 patches 82 of the solvent are applied to form the tacky solution. In FIG. 6, there is shown the label of FIG. 5 partially wrapped around a container 85.

In preparing the label of FIG. 5, the ledaing edge 76 of the label may be extended only as it passes the glue roller 34 while the trailing edge gripping pad 17 is extended as it passes both glue rollers 32 and 34. At glue roller 32 one or more patches of solvent are applied to the trailing edge and at glue roller 34, short strips of hot melt adhesive are applied to both leading and trailing edges.

In the event that the vacuum pads 16 or 17, or the knives 24, become worn, they may be replaced without replacing the drum itself 12. This represents a substantial saving over conventional machines wherein the entire label transport drum requires replacement from time to time, at considerable expense.

While this invention has been described in conjunction with a preferred embodiment thereof, it is obvious that modifications and changes therein may be made by those skilled in the art to which it pertains without departing from the spirit and scope of this invention, as defined by the claims appended hereto.

What is claimed as invention is:

1. The method of applying plastic labels to a succession of containers comprising the steps of:

providing a rotatable label transport drum having first and second vacuum pads thereon to grip, respectively, the leading and trailing edges of a container label;

said vacuum pads being radially movable on said drum;

also providing adjacent said drum a solvent applicator to form a tacky solution with the plastic material of a label pressed against it and, arcuately spaced from said solvent applicator, a glue applicator;

rotating said drum;

delivering a strip of plastic label material to said drum and severing it into individual label lengths;

holding said first vacuum pad retracted as it passes said solvent applicator and extending said first vacuum pad as it passes said glue applicator;

extending said second vacuum pad as it passes said solvent applicator; and transferring said label to a container.

2. The method defined by claim 1 including the step of extending said second vacuum pad as it passes said glue applicator.

3. The method defined by claim 2 wherein:

said solvent applicator applies spaced patches of solvent to a label pressed against it; and said glue applicator applies an intermediate strip of adhesive to a label pressed against it.

4. The method defined by claim 1 including the step of holding said second vacuum pad retracted as it passes said glue applicator.

5. The method of applying a plastic label to a container comprising the steps of:

providing a rotatable label transport drum having vacuum means thereon to grip a container label;

severing a label from a strip of polymer label material and applying said label to said drum;

while said label is rotating on said drum applying a hot melt adhesive to an area along the leading edge of said label;

applying a solvent of said polymer to form a tacky solution in an area along the trailing edge of said label; and transferring said label to a container.

6. The method of applying a plastic label to a container defined by claim 5 wherein;

said solvent is applied to said label in patches in the trailing corners thereof.

7. The method of applying a plastic label to a container as defined by claim 6 including the step of:

applying a strip of hot melt adhesive to the trailing edge of said label intermediate and patches of solvent.

* * * * *